US012590502B2

(12) United States Patent
Parsley et al.

(10) Patent No.: US 12,590,502 B2
(45) Date of Patent: Mar. 31, 2026

(54) AUTOMATIC SETTING SUPPORT FOR A SLIP HANGER

(71) Applicant: Baker Hughes Pressure Control LLC, Houston, TX (US)

(72) Inventors: Ryan Joseph Parsley, Houston, TX (US); Brian N. Munk, Houston, TX (US); Xichang Zhang, Houston, TX (US)

(73) Assignee: BAKER HUGHES PRESSURE CONTROL LLC, Houston, TX (US)

( * ) Notice: Subject to any disclaimer, the term of this patent is extended or adjusted under 35 U.S.C. 154(b) by 0 days.

(21) Appl. No.: 19/072,839

(22) Filed: Mar. 6, 2025

(65) Prior Publication Data

US 2025/0283388 A1 Sep. 11, 2025

Related U.S. Application Data

(63) Continuation of application No. 18/598,900, filed on Mar. 7, 2024, now abandoned.

(51) Int. Cl.
*E21B 33/04* (2006.01)

(52) U.S. Cl.
CPC ..... *E21B 33/0422* (2013.01)

(58) Field of Classification Search
None
See application file for complete search history.

(56) References Cited

U.S. PATENT DOCUMENTS 1,460,018 A * 6/1923 Gibbs ..... E21B 19/07 294/86.23
1,795,578 A 3/1931 Smith
1,802,565 A 4/1931 Lacey
2,542,302 A 2/1951 Barker
2,563,851 A 8/1951 Lundeen et al.
2,642,642 A * 6/1953 Ware ..... E21B 19/07 188/67
2,683,047 A 7/1954 Herbert
2,775,472 A 12/1956 Brown
(Continued)

FOREIGN PATENT DOCUMENTS

CN 110761731 A 2/2020

OTHER PUBLICATIONS

Han et al., "Study on surface configurations and force transfer mechanism of dual-wedge shaped slips for liner hanger," Energies 2023, 16, 3177, https://doi.org/10.3390/en16073177, Mar. 31, 2023, 3 pages.

(Continued)

*Primary Examiner* — Kipp C Wallace
(74) *Attorney, Agent, or Firm* — Law Office of Darin Duphorne, PLLC

(57) ABSTRACT

In at least one embodiment, a slip hanger or a packoff to be used with oilfield equipment is disclosed as having slip segments to be supported by a slip bowl and to be associated with pins that have a self-retractive attribute. The self-retractive attribute is to allow engagement of the slip segments with a housing of the oilfield equipment based in part on a first direction of movement of the plurality of slip segments and is to allow an interface with individual ones of the plurality of slip segments in a second direction of movement for the plurality of slip segments.

20 Claims, 10 Drawing Sheets

(56) References Cited

U.S. PATENT DOCUMENTS

| | | | |
|---|---|---|---|
| 3,122,811 | A | 3/1964 | Gilreath |
| 3,358,341 | A | 12/1967 | Burstall |
| 3,437,356 | A | 4/1969 | Todd et al. |
| 4,665,979 | A | 5/1987 | Boehm, Jr. |
| 4,784,222 | A | 11/1988 | Ford |
| 5,031,695 | A | 7/1991 | Cain et al. |
| 5,566,758 | A | 10/1996 | Forester |
| 5,727,631 | A | 3/1998 | Baker et al. |
| 5,992,801 | A | 11/1999 | Torres |
| 6,644,401 | B1 | 11/2003 | Miller |
| 10,590,727 | B1 | 3/2020 | Christopherson et al. |
| 10,767,435 | B2 | 9/2020 | Lugo et al. |
| 10,851,609 | B2 | 12/2020 | Kauffmann et al. |
| 2014/0262538 | A1 | 9/2014 | Louviere et al. |
| 2017/0089162 | A1 | 3/2017 | Barnhart et al. |
| 2021/0062604 | A1 | 3/2021 | Monjure et al. |
| 2022/0195826 | A1 | 6/2022 | Cheng et al. |
| 2023/0407729 | A1 | 12/2023 | Moreno et al. |

OTHER PUBLICATIONS

Non-Final Office Action issued in U.S. Appl. No. 18/598,900, dated Mar. 7, 2024.

International Search Report and Written Opinion issued in PCT Application No. PCT/US2025/018799, dated Jul. 2, 2025.

* cited by examiner

AUTOMATIC SETTING SUPPORT FOR A SLIP HANGER

CROSS-REFERENCES TO RELATED APPLICATION(S)

This is a continuation application that is related to and that claims the benefit of priority from U.S. patent application Ser. No. 18/598,900, filed Mar. 7, 2024, and entitled "AUTOMATIC SETTING SLIP HANGER SUPPORT WITH RETRIEVAL CAPABILITIES," the entire contents of which is incorporated by reference herein and form a part of this specification for all intents and purposes.

BACKGROUND

1. Technical Field

This disclosure relates generally to oilfield equipment and more particularly to systems and methods for slip hanger or a packoff to be used with oilfield equipment.

2. Description of the Prior Art

A slip hanger, such as a manual slip hanger, is a type of wellhead equipment used with oilfield equipment to support the weight of oilfield tubulars or strings in a wellbore; these oilfield tubulars may be a casing or tubing strings. The slip hanger may be installed within the wellhead and may include a series of slips that grip a casing string. A housing may be provided to hold the slip hanger in place. Further, a mechanism may be provided within the slip hanger for releasing and setting the slips. The slip hanger may be used in conjunction with a casing or tubing head, which may form part of a wellhead via a flanged, threaded, or other type of mechanical connection. The casing or tubing head may be referred to as a casing head herein, and the tubular may be referred to as a casing string. The casing head includes a bore that may be slightly larger than the casing string, which allows the casing string to be run through it. The slip hanger may be placed within casing head and the slips may be set to grip the casing string. For removal of the casing string, slips may be released by releasing the casing tension and the casing string can be pulled out of the wellbore. In a similar manner, a packoff is a mechanical seal used in oilfield equipment to prevent fluid leakage between sections of the equipment, such as to isolate the annulus volume from a bore volume in a wellhead. In all such applications, there may be issues pertaining to higher pressure and pipe loads, where radial forces exerted may cause a split in halves of a slip hanger or packoff to move apart.

SUMMARY

In at least one embodiment, a system for a slip hanger or a packoff to be used with oilfield equipment includes multiple slip segments that are to be supported by a slip bowl and that are to be associated with multiple pins having a self-retractive attribute. The self-retractive attribute allows engagement of the slip segments with a housing of the oilfield equipment based in part on a first direction of movement of the plurality of slip segments. Further, the self-retractive feature is provided, at least in part, by an angled profile for individual ones of the plurality of pins. The angled profile is to interface with a corresponding angled profile of individual ones of the plurality of slip segments. A second direction of movement of the plurality of slip segments allows disengagement of the plurality of pins from the housing by the self-retractive attribute and allows retraction of the plurality of pins into the slip bowl by the self-retractive attribute.

In at least one embodiment, a method for a slip hanger or a packoff to be used with oilfield equipment includes providing multiple slip segments to be supported by a slip bowl. The method includes providing multiple pins having a self-retractive attribute to be associated with the slip segments and with the slip bowl. The method includes allowing, by at least in part the self-retractive attribute, engagement of the plurality of slip segments with a housing of the oilfield equipment based in part on a first direction of movement of the plurality of slip segments. The housing surrounds, at least partially, the slip bowl. The self-retractive attribute is provided, at least in part, by an angled profile for individual ones of the plurality of pins. The angled profile is to interface with a corresponding angled profile of individual ones of the plurality of slip segments A second direction of movement of the plurality of slip segments allows disengagement of the plurality of pins from the housing by the self-retractive attribute and allows retraction of the plurality of pins into the slip bowl by the self-retractive attribute.

BRIEF DESCRIPTION OF DRAWINGS

Some of the features and benefits of the present disclosure having been stated, others will become apparent as the description proceeds when taken in conjunction with the accompanying drawings, in which.

Figure 1:
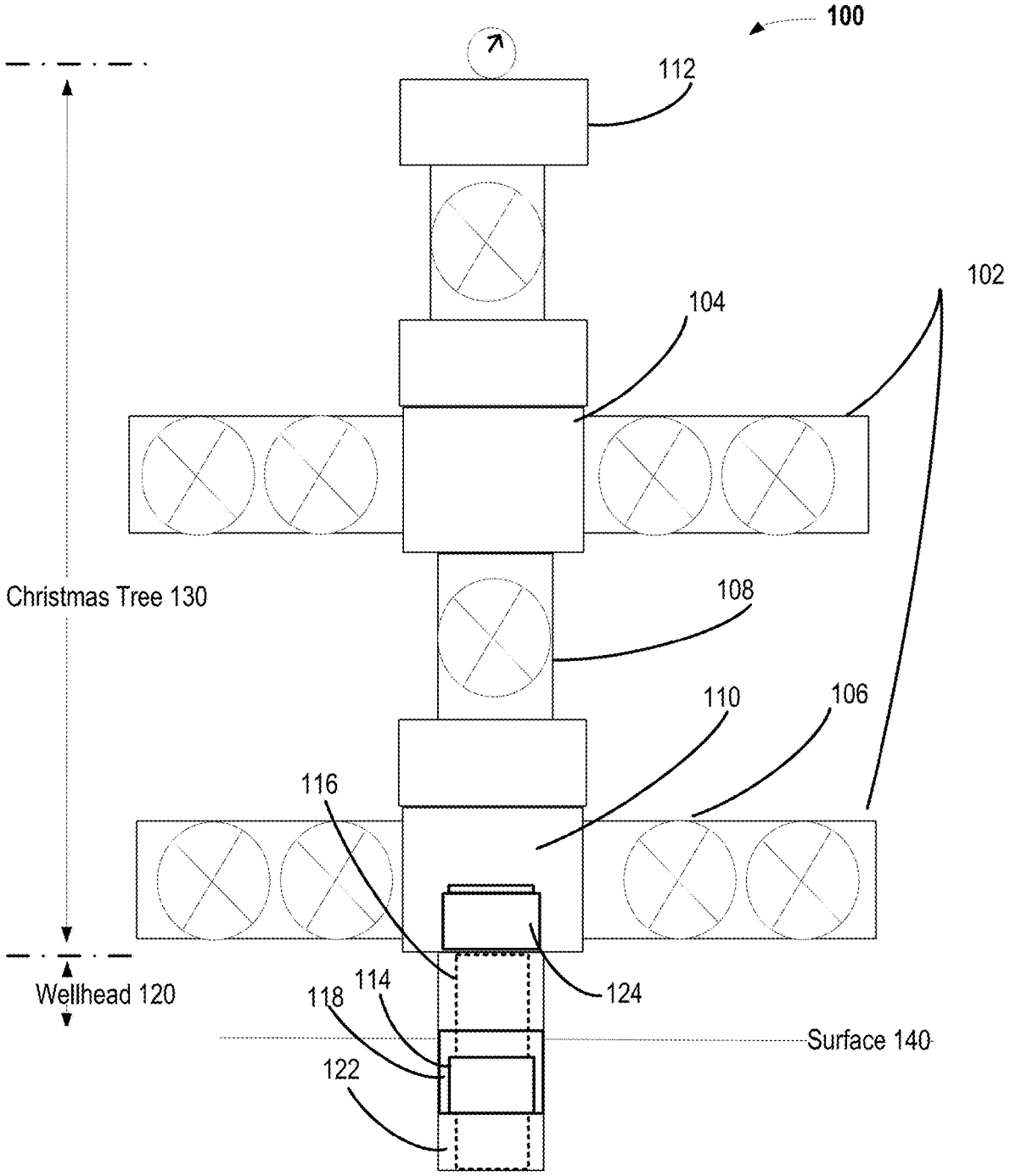
FIG. 1 is a block diagram of certain oilfield equipment that is subject to a slip hanger or a packoff having pins with a self-retractive attribute, as detailed herein and in accordance with at least one embodiment.

While the disclosure will be described in connection with the preferred embodiments, it will be understood that it is not intended to limit the disclosure to that embodiment. On the contrary, it is intended to cover all alternatives, modifications, and equivalents, as may be included within the spirit and scope of the disclosure as defined by the appended claims.

DETAILED DESCRIPTION

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

In at least one embodiment, to resolve issues, such as described above, a slip hanger or packoff herein is provided with automatic engagement and retrieval capabilities, making it an automatic-setting slip hanger or packoff. Therefore, reference is made to one of the slip hanger or the packoff but can apply to either, unless indicated otherwise. A slip hanger includes automatic expanding slip segment support pins, representing a setting support, having a self-retractive attribute for engagement and retrieval. This aims to strengthen and minimize casing hanger deformation under heavy loads from casing weight or pressure. The pins herein allow the slip hanger to automatically transfer radial forces from a casing string, such as a pipe, and from slip segments, directly to the housing.

The slip hanger having such pins also ensure that its halves remain together. This enables a seal associated with the slip hanger or packoff to function effectively, but also reduces slip hanger materials otherwise used in such applications. In addition, it is also possible to reduce a touch time associated with these components as no additional tools are required to enable the engagement or retrieval with the self-retractive attribute of the pins. The self-retractive attribute of the pins may include one or more of a spring feature, a contact surface, or an angled profile of the pins to provide radial outward movement and retraction inward movement in response to axial movement of slip segments of the slip hanger or packoff. The self-retractive attribute may also be provided by a free floating state of the pins with respect to the slip segments, the slip bowl, and the housing, where the pins retract in the absence of a specific applied or intentional force to cause retraction.

The pins herein may be arranged circumferentially and can automatically expand to provide the radial outward movement or contract to provide the retraction inward movement, based in part on an angled interface with slip segments. The expansion enables engagement of the pins with the housing through the movement of the slip segments and the contraction enables retrieval of the slip segments by a disengagement of the pins. In one example, the slip segments may be imparted with an upward axial movement that causes its angled profile to interface less so with the slip segments, which causes the disengagement of the pins from the housing. In a similar manner, a downward axial movement can cause the angled profile to interface more so with the slip segments, which causes the engagement of the pins from the housing.

In at least one embodiment, therefore, the interface alone may not be the cause of the movement in the pins, as a threshold amount of axial force or movement in the slip segments may be required to be translated to radial movement of the pins. Further, relief of an imparted downward axial movement may be sufficient for the disengagement to occur. In at least one embodiment, however, an upward axial movement may be required. In all such axial upward movements, retraction of the pins into the slip hanger occurs and allows retrieval of the slip hanger. The pins allow for efficiency and functionality of the slip hanger under high-pressure and under heavy-load conditions. The slip hanger herein is also able to at least address issues of seal leakage by keeping its halves, such as of the slip bowl, together.

FIG. 1 is a block diagram of certain oilfield equipment 100 that is subject to a slip hanger or a packoff having pins with a self-retractive attribute, as detailed herein and in accordance with at least one embodiment. The oilfield equipment 100 may include a Christmas tree 130 over a wellhead 120 located at or about a surface layer 140. The Christmas tree 130 may include on one or more branches 102 having valves thereon of the oilfield equipment 100.

Further, as illustrated in FIG. 1, the oilfield equipment 100 may include a top connector 112 that is connected at a top of a studded cross 104. There may be multiple flow line gate valves and multiple kill line gate valves, generally illustrated as valves 106. These valves 106 may be on opposite sides of a studded cross 104. Further, the oilfield equipment may include one or more master gate valves 108, such as an upper and a lower master gate valve. A tubing head adapter may be connected between a tubing head 110 and at least one of the master gate valves 108.

In at least one embodiment, a system 114 for a slip hanger or a packoff may be used to perform operations associated with a tubing string or tubular 116 and may be located within a casing hanger spool 118, which may be part of or associated with a housing of a wellhead 120. In at least one embodiment, a system 114 of a slip hanger or a packoff having inner bowl segments to go along with the slip segments. The slip segments and the inner bowl segments may be held together, in part, by the use of the pins herein and may be used to perform operations associated with a tubing string 116. Aspects of a packoff may be located within a tubing head 110 of the oilfield equipment 100, and may be used to perform other operations associated with the tubing string 116.

In at least one embodiment, a system 114 of a slip hanger or a packoff having pins with self-retractive attributes and bowl segments may be used with other hangers, including a tubing hanger associated with a tubing, a production casing hanger associated with a production casing, or an intermediate casing hanger associated with an intermediate casing. Therefore, the illustrated tubing string 116 may be a series of concentric oilfield tubulars (casing or tubing), each having an independent hanger that may benefit from the present system of a slip hanger having pins with a self-retractive attribute.

In at least one embodiment, a casing string may line walls of a wellbore and may be supported by a slip hanger 114 mounted in a wellhead 120, in association with one or more of a casing hanger spool 118 or another feature. The slip hanger system may be referred to also as a casing hanger. In at least one embodiment, wedge-shaped segmented slips or slip segments may be provided for coupling between the slip hanger 114 and the tubing string 116. The slip segments may have an inner profile that is textured and an outer profile that is smooth. This is detailed further in at least FIG. 3 herein. Further, compression seal assemblies may be provided for preventing pressure communication and may be provided between the tubing string 116 and wellhead 120.

In at least one embodiment, a system 114 of a slip hanger or a system 124 of a packoff may include multiple bowl segments to support multiple slip segments on an inner side. Further, the bowl segments may include at least a first retention feature to enable association with at least a second retention feature of the slip bowl to bring together the bowl segments. For example, the retention features may include fasteners or shoulders that interface to transfer load to a load shoulder of the wellhead (or housing) to support the slip bowl for the slip hanger or packoff to be used with the oilfield equipment.

The system 114; 124 may be coupled together with threaded fasteners, including screws, bolts, studs, and nuts. These threaded fasteners may be torqued to an amount that causes the compression plate with grooves or slots to axially compress to provide a compressive preload force to the compression seal, to isolate the annulus between the tubing string 116 and wellhead 120. In at least one embodiment, instead of the threaded fasteners, the top plate and a seal adjacent to the top plate may be associated together by an internal lockdown. The internal lockdown may include other types of screws, such as lock screws without the aligned stud holes. These lock screws may be associated with the wellhead 120, and provide a compressive force to the slip hanger compression plate.

Figure 2A:
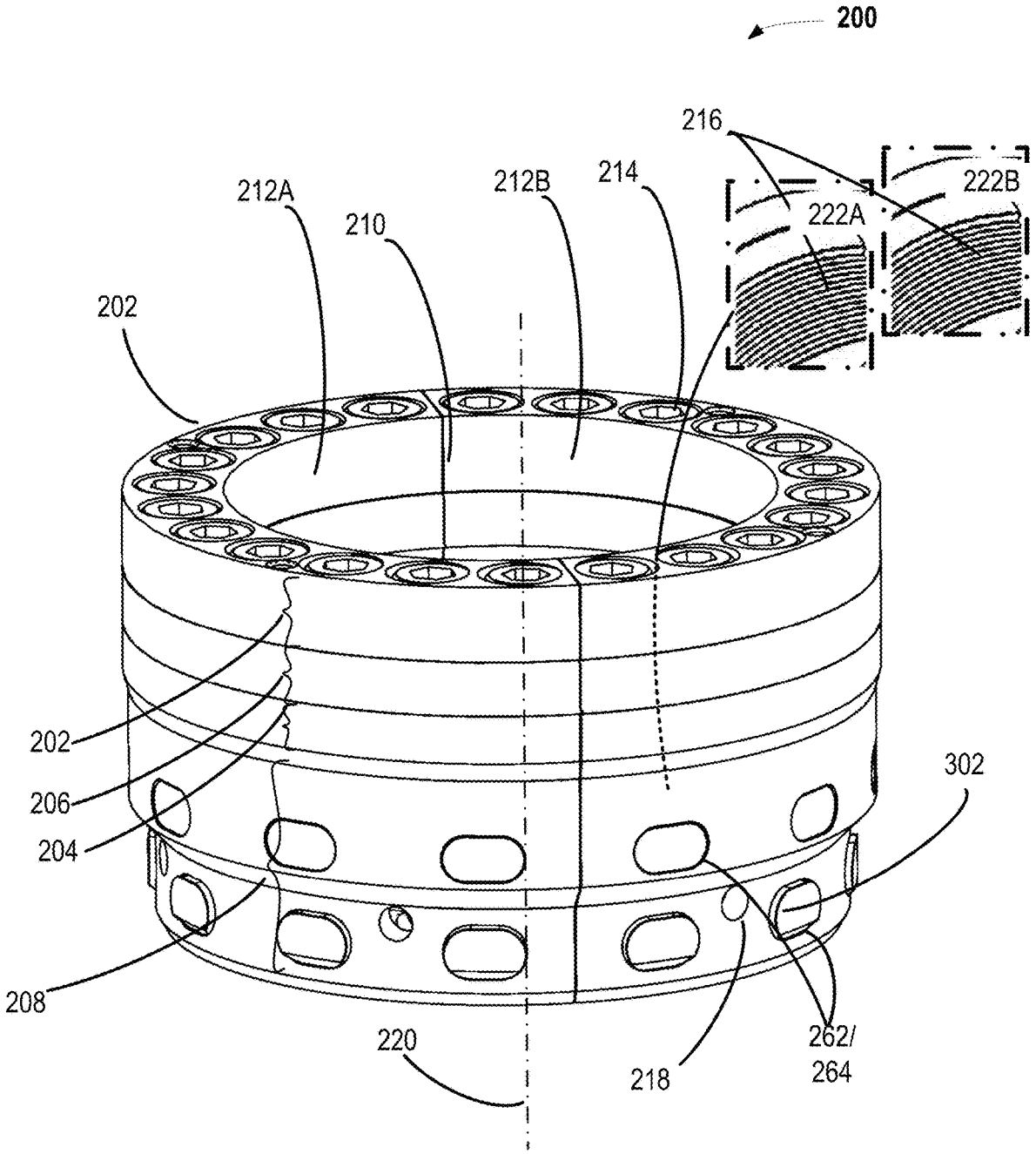
FIG. 2A is a perspective view of aspects of a slip hanger or a packoff having pins with a self-retractive attribute, in accordance with at least one embodiment.

FIG. 2A is a perspective view of aspects 200 of a slip hanger or a packoff having pins 302 with a self-retractive attribute, in accordance with at least one embodiment. The self-retractive attribute is detailed further with respect to at least FIG. 3 herein. The pins 302 are provided through respective pass-through features 262 or 264. In at least one embodiment, the system 114 herein is also referred to as seal assembly and the system 114; 124 is made up of a top plate 202 (also referred to also as a compression plate), a seal or seal element 206, a bottom plate 204, a slip (or outer) bowl 208, and slips or slip segments 222A, 222B (which are between the slip bowl 208 and the tubing string 116, as illustrated and described with respect to at least FIGS. 4A-5B) that engage a casing string. The slip bowl 208 may be provided in two or more bowl segments 212A, 212B. Further, each of the slip segments 222A, 222B and the bowl segments 212A, 212B are illustrated as two semi-circular or 180 degree members, but may include more than two segments.

The bowl segments 212A, 212B may be joined at a split 210, whereas the slip segments may be joined similarly at their respective segments and in a manner to not have any leak therethrough. A seal assembly and the system 114; 124 may generally be a slip hanger or packoff depending on its operations and usage in the oilfield equipment 100. The seal 206 occupies an annulus seal gland, which is formed by a slip bowl 208 and portions of the tubular 116, a housing of a wellhead 120, and the top plate 202 that are annularly around the slip bowl 208. As a result, a gland volume of the annulus seal gland is in reference to the space formed within the slip bowl 208 and portions of the tubular 116, a housing of a wellhead 120, and the top plate 202 that are annularly around the slip bowl 208. FIG. 2A also illustrates that side fasteners 218 may be provided that is distinct from the fasteners 214 at the top plate 202. In at least one embodiment, the side fasteners 218 may be provided to associate the bowl segments 212A, 212B with the slip segments 222A; 222B.

In at least one embodiment, the top plate 202 is for a slip hanger or a packoff and forms at least one part of a slip bowl 208 to retain a seal 206 with the slip bowl 208. In at least one embodiment, the top plate 202 restrains the seal 206 in at least one direction. The top plate 202 is associated with the seal 206, a bottom plate 204, which may be optional, and the slip bowl 208 under a fastener preload (such as from the fasteners 214), under thermal expansion, or under pressure load of the seal assembly and the system 114; 124. FIG. 2A illustrates that a tubular 116 is provided through an axis 220 of the system of the slip hanger or packoff.

In at least one embodiment, example materials for at least the top plate 202 and other plates to be used with the slip bowl 208 include elastic materials, such as carbon steel or stainless steel, whereas the seal 206 may be of an elastomer material. In at least one embodiment, such elastomer may include hydrogenated nitrile butadiene rubber (HNBR) or Polyether ether ketone (PEEK).

In at least one embodiment, the bowl segments 212A, 212B are axially fastened together from a top side of the top plate 202 using fasteners 214 that are threaded and that thread into a bolt hole, and through the seal 206 before reaching the slip bowl 208. Even though illustrated below the top plate 202, the seal 206 may be above the top plate 202, in at least one embodiment. The fasteners 214 may be hexagonal headed socket but may be any suitable lock screws or studs used to bring together the compression plate 202 and the compression seal 206.

Figure 2B:
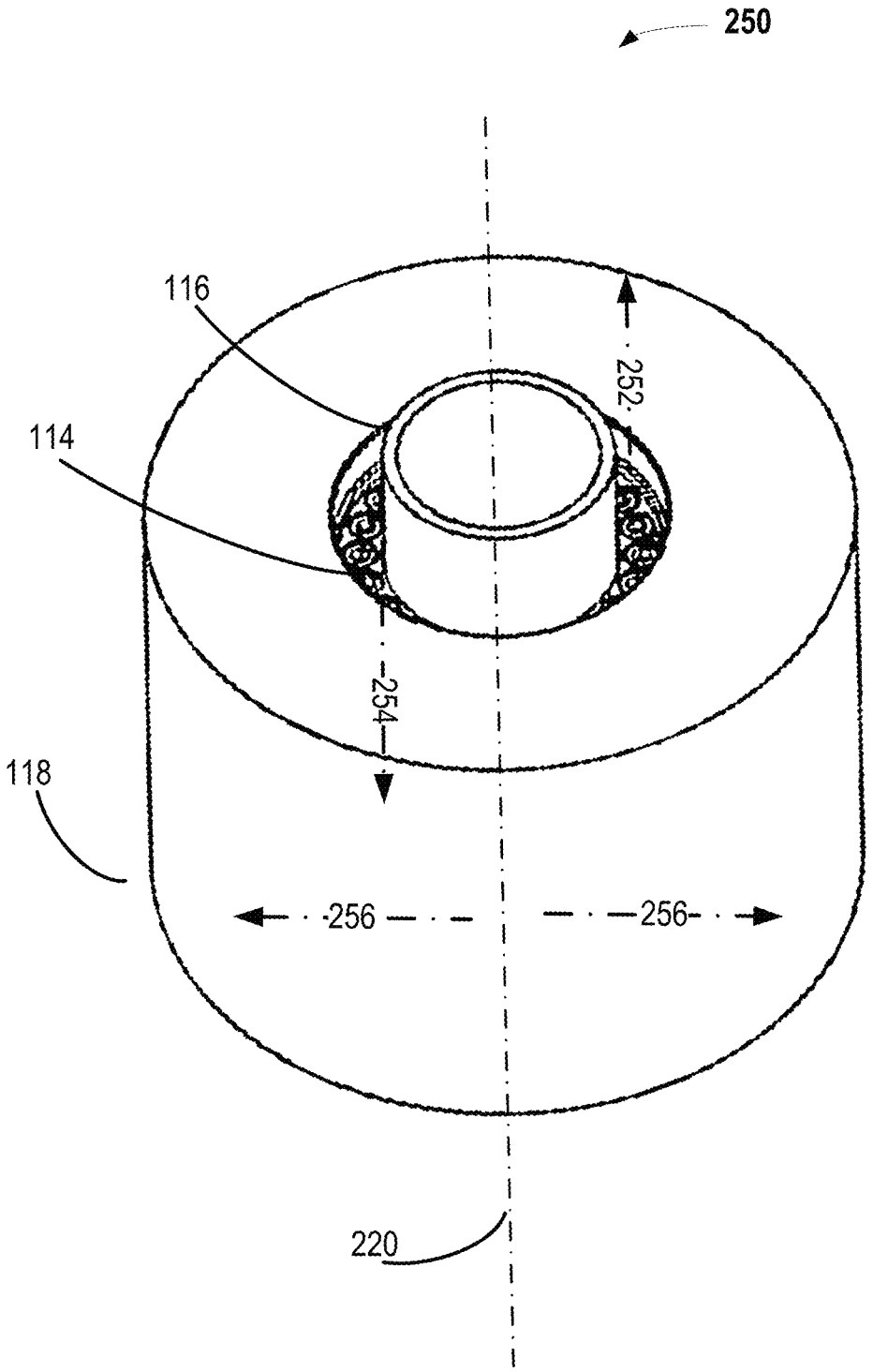
FIG. 2B is a perspective view of aspects of a slip hanger or a packoff within a spool, in accordance with at least one embodiment.

FIG. 2B is a perspective view of aspects 250 of a slip hanger or a packoff within a spool, in accordance with at least one embodiment. As described with respect to FIG. 1, a system 114 for a slip hanger or a packoff may be used to perform operations associated with a tubing string 116 and may be located within a casing hanger spool 118. In at least one embodiment, the system 114 of a slip hanger or a packoff herein may have bowl segments that may be provided with the slip segments. Then, the pins herein may be used with the slip segments and the bowl segments to hold them together. This provides an engaged position for the pins, the slip segments, and the bowl segments. In the engage position, operations associated with a tubing string 116 of the oilfield equipment 100 may be performed.

Further, the slip segments 222A, 222B include an inner profile 216 that is textured, as illustrated, to interface with the tubular 116. For example, the tubular 116 asserts a downward load and, therefore, movement to the slip segments 222A, 222B. The texture may be upward facing horizontal and circumferential grooves. These grooves allow gripping of the tubular 116 and allow transfer of load from the tubular 116 to the slip segments 222A, 222B. FIGS. 1-2B also illustrate that the slip hanger is aligned with an axis 220 of a wellbore. Therefore, upward axial movement 252 herein, unless otherwise described, is aligned in parallel with the axis 220 of the wellbore and is outward with respect to the wellbore, whereas downward axial movement 254 herein, unless otherwise described, is aligned in parallel with the axis 220 of the wellbore and is inward with respect to the wellbore. The axial movements 252, 254 are described further with other figures herein but may be caused by installation, preloading, loading, and retrieval of one or more of the tubular 116, the slip segments 222A, 222B, or the slip bowl 208.

In one example, the slip segments 222A, 222B are supported by the slip bowl 208 herein and are associated with pins 302, such as described with respect to FIGS. 4A-5B. The pins 302 have a self-retractive attribute, as described further with respect to at least FIG. 3. The self-retractive attribute is to enable engagement of the slip segments 222A, 222B with a housing of the oilfield equipment based in part on a first direction of movement that may be the downward axial movement 254 of at least the slip segments. Further, the self-retractive attribute is to enable retrieval of the slip segments 222A, 222B based in part on a second direction of movement that may be the upward axial movement 252 of at least the slip segments 222A, 222B. Therefore, the first direction of movement of the slip segments 222A, 222B is downward with respect to the axis 220 of the wellbore and the second direction of movement of the slip segments 222A, 222B is upward with respect to the axis 220 of the wellbore. FIG. 2B also illustrates that the system 114 herein is subject to radial forces in the radial directions 256 that may act on pins 302 of the system 114 during its operation.

Figure 2C:
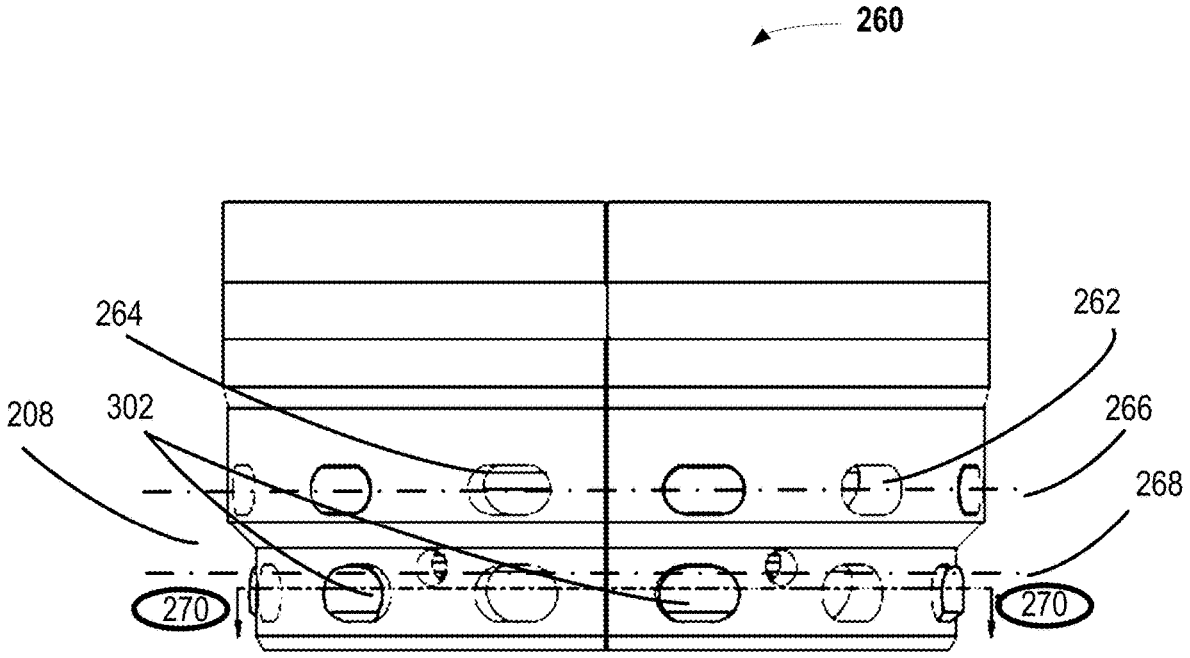
FIG. 2C is a side view of aspects of a slip hanger or a packoff having pins with a self-retractive attribute, in accordance with at least one embodiment.

FIG. 2C is a side view of aspects 260 of a slip hanger or a packoff having pins with a self-retractive attribute, in accordance with at least one embodiment. FIG. 2C illustrates that the slip bowl 208 may include pass-through features 262, 264. The pass-through features 262, 264 enable the pins to pass through the slip bowl 208 and to be in engagement with the housing, such as described with respect to at least FIGS. 5A, 5B herein. Further, as illustrated, individual ones of the pass-through features 262, 264 are in complementary locations in the system 114. A complementary location, as used herein, is in reference to alignment of each of the pass-through features 262, 264 being opposite to another one of the pass-through features 262, 264. The complementary location may be symmetrical or asymmetrical for the pass-through features and, consequently, for the pins. Further, the alignment enables uniform engagement and disengagement, as well as loading, preloading, and other aspects with respect to applied or asserted forces in the system 114. In at least one embodiment, the forces may include radial forces in radial directions. Therefore, the complementary location provides for substantially equal distribution of radial forces in the radial directions and through the pins provided in the pass-through features 262, 264.

FIG. 2C also illustrates that the pass-through features 262, 264 for including therein the pins may include a first set 266 of the pass-through features 262, 264 and a second set 268 of the pass-through features 262, 264. This is so that the pins through the first set 266 and through the second set 268 of the pass-through features 262, 264 may be in engagement with the housing independent of or concurrent with each other. Therefore, in at least one embodiment, it is not required that pins through the first set 266 of pass-through features 262, 264 engage the housing at the same time as pins through the second set 268 of the pass-through features 262, 264. However, in at least one embodiment concurrent engagement of all the pins of the first set 266 and the second set 268 of the pass-through features 262, 264 is possible in the system 114 herein.

Figure 2D:
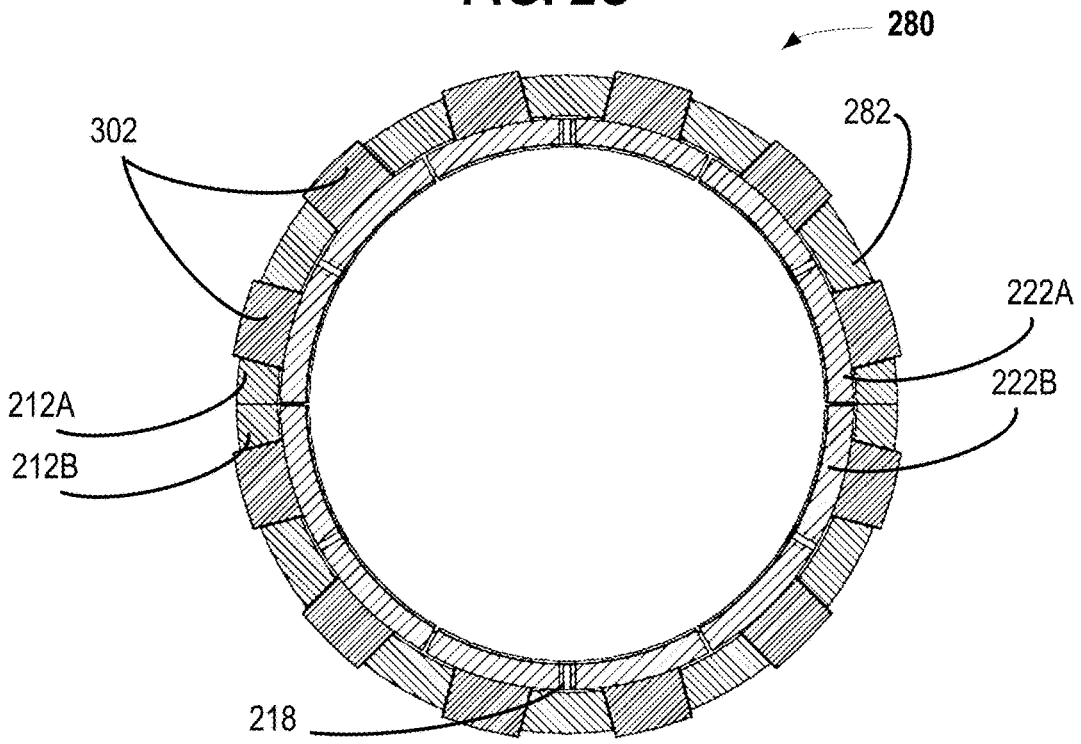
FIG. 2D is a plan view of aspects of a slip hanger or a packoff having pins with a self-retractive attribute, in accordance with at least one embodiment.

FIG. 2D is a plan view of aspects 280 of a slip hanger or a packoff having pins with a self-retractive attribute, in accordance with at least one embodiment. Further, the plan view is at a section 270 of the slip bowl 208 of FIG. 2C. Although FIG. 2D illustrates a section 270 of the side view in FIG. 2C, the pins 302 in FIG. 2D are illustrated through every pass-through feature of the slip bowl 208, but is illustrated at alternating pass-through features of the slip bowl 208. Therefore, the pins need not be in every pass-through feature, in at least one example. In at least one embodiment, although illustrated in an oval shape, the pass-through features 262, 264 and the pins may be of any suitable shape that is readily understood upon reviewing this disclosure, to perform the features described throughout herein.

In FIG. 2D, the slip bowl 208 is illustrated in two bowl segments 212A, 212B and the multiple slip segments, including at least the two slip segments 222A, 222B of FIG. 2A are illustrated. One or more of the bowl segments 212A, 212B and the slip segments 222A, 222B may be arc-shaped or semi-circular shaped members. FIG. 2D also illustrates receiving features for that side fasteners 218 that may be provided, which may be distinct from the fasteners 214 at the top plate 202 of the system 114. The side fasteners 218 may be provided to associate the bowl segments 212A, 212B with the slip segments 222A, 222B.

Figure 3:
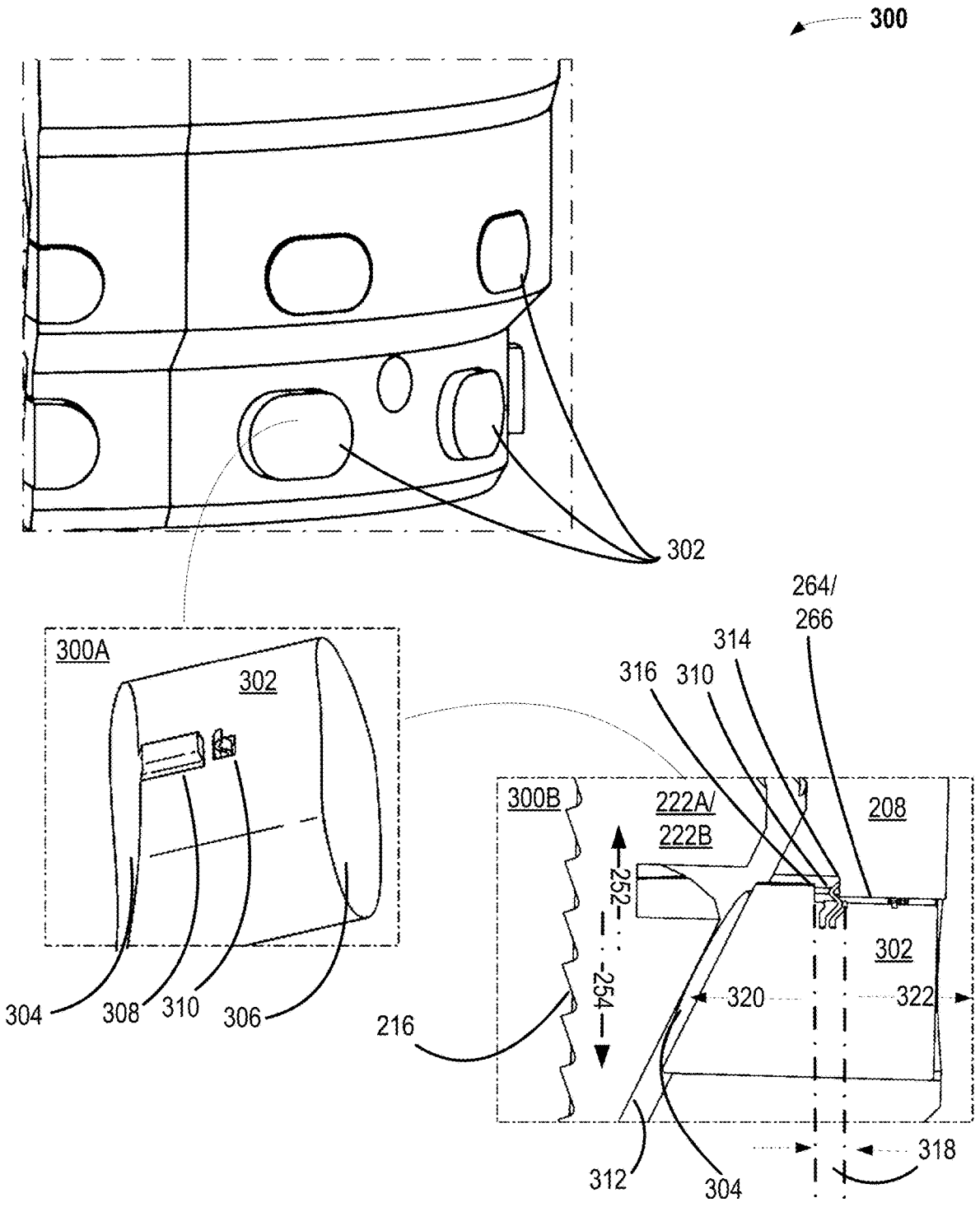
FIG. 3 illustrates different details views of a pin with a self-retractive attribute to be used with a slip hanger or a packoff herein, in accordance with at least one embodiment.

FIG. 3 illustrates different details views 300 of a pin with a self-retractive attribute to be used with a slip hanger or a packoff herein, in accordance with at least one embodiment. In FIG. 3, the excerpt 300A provides a perspective of at least one pin 302 that includes a self-retractive attribute, while the further excerpt 300B provides a perspective of the pin 302 within a pass-through feature 262, 264 of a slip bowl 208. Individual ones of the pins, such a pin 302, may include a retention feature 308 with a surface 316 to engage with a shoulder 314 of the slip bowl 208. This engagement can prevent the individual ones of the pins 302 from extending past the shoulder 314 of the slip bowl 208. A threshold 318 formed by such a potential engagement may represent an amount of radial movement available in the individual ones of the pins 302. Therefore, the individual ones of the pins 302 are prevented from extending past the threshold 318, in one example.

Further, individual ones of the pins, such as a pin 302, may include a spring feature 310, as part of the self-retractive attribute. The spring feature 310 allows for a radial outward movement 322 and for a retraction inward movement 320 for each of the pins. The radial outward movement 322 and the retraction inward movement 320 may be with respect to at least the threshold 318 of radial movement, for the individual ones of the pins. In one example, a downward axial movement 254 of a slip segment 222A; 222B causes the radial outward movement 322 of the pin 302. In one example, an upward axial movement 252 of a slip segment 222A; 222B causes the retraction inward movement 320 of the pin 302. Further, the slip segment 222A; 222B includes an inner profile 216 that is textured and an angled profile 312 that is smooth to interface against a corresponding profile 304 of each of the pins, such as the illustrated pin 302. Therefore, movements imparted into a tubular 116, against the inner profile 216 of the slip segment, may cause, at least in part, the downward axial movement 254 of the slip segment 222A; 222B and the radial outward movement 322 of the slip segment 222A; 222B.

Further, FIG. 3 also illustrates that each pin 302 includes a further profile 306 that is opposite the angled profile 304. This further profile 306 is to engage or disengage from the casing hanger spool 118, which is part of a housing or is associated with the housing of a wellhead 120. In one example, there may be an indentation of the casing hanger spool 118 to receive the further profile 306 of the pin 302. In one example, the spring feature 310 is energized when the pin 302 is extended by the radial outward movement 322. For example, the spring feature 310 is energized on being loaded against a shoulder 314 of the slip bowl 208 that also provides engagement for the retention feature 308 if the pin 302 is extended further than the spring's allowances, for instance. The spring feature 310 then deenergizes when the pin 302 is subject to the retraction inward movement 320. The extension and the retraction of each pin 302 may be caused in part by the axial movements 252, 254, and is fully supported by the spring feature 310. Therefore, the spring feature 310 is part of the self-retractive attribute that enables automatic engagement and retrieval capabilities for the slip hanger as a whole, and make such slip hangers an automatic-setting slip hanger.

In at least one embodiment, the self-retractive attribute is also provided, at least in part, by the angled profile 304 for individual ones of the pins 302. For example, the angled profile 304 is to interface with the corresponding angled profile 312 of the individual slip segments 222A; 222B during the upward axial movement 252 for the retrieval of the slip segments. This upward axial movement 252 enables disengagement of the pins 302, via the spring feature 310 deenergizing or unloading from against a shoulder 314 of the slip bowl 208. The disengagement is, therefore, also from the housing. Further, the upward axial movement 252 enables retraction of the pins 302 into the slip hanger, such as by being retracted into the slip bowl 208.

In at least one embodiment, the self-retractive attribute is also provided, at least in part, by the angled profile 304 of the pins 302, where the angled profile 304 is to interface with a corresponding angled profile 312 of individual ones of the slip segments 222A; 22B during a downward axial movement 254 for the engagement of the slip segments with the housing. This downward axial movement 254 enables the engagement of the pins 302 with the housing based in part of an extension of the pins 302 into the housing, from slip hanger. This downward axial movement 254 enables engagement of the pins 302, via the spring feature 310 energizing or loading from against a shoulder 314 of the slip bowl 208. The engagement is, therefore, also from the housing. In addition, these aspects demonstrate that the angled profile 304 herein provides, at least in part, the self-retractive attribute of the pins of the slip hanger.

In at least one embodiment, the pins 302 enable transfer of radial forces, from a tubular string 116 associated with the slip segments 222A; 222B, into the housing. Further, at least the downward axial movement 254 supports the transfer of the radial forces being an automatic transfer based at least in part on the downward axial movement 254 of the slip segments 222A; 222B causing interaction of the slip segments 222A; 222B against the pins 302 to extend the pins into the housing. In at least one embodiment, individual ones of the pins 302 are in complementary locations in the system 114 to provide substantially equal distribution of radial forces in the radial directions around a circumference of the casing hanger spool 118.

Figure 4A:
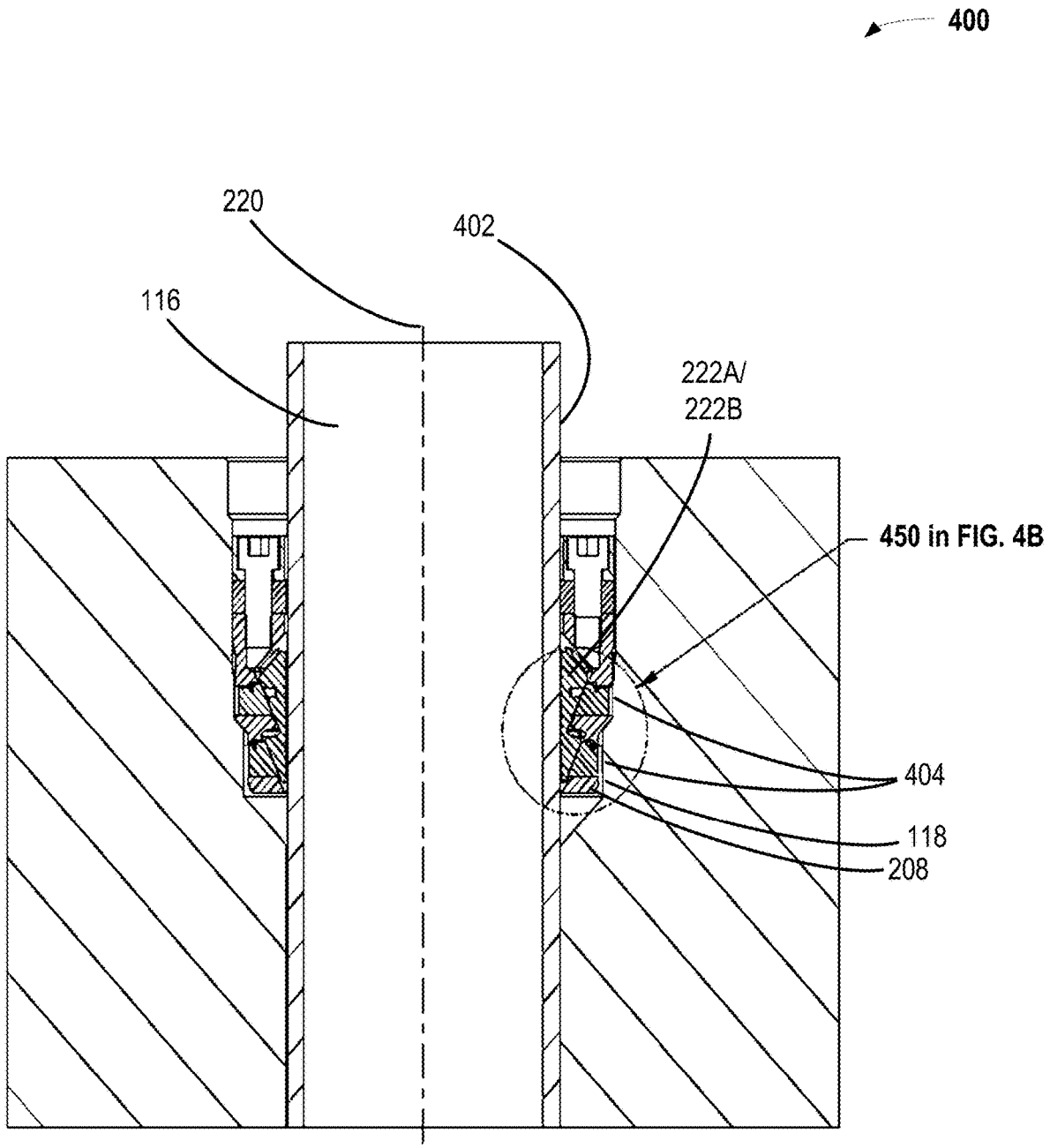
FIG. 4A is a section view of aspects of a slip hanger or a packoff having pins with a self-retractive attribute and in a disengaged position, in accordance with at least one embodiment.

FIG. 4A is a section view of aspects 400 of a slip hanger or a packoff having pins with a self-retractive attribute and in a disengaged position, in accordance with at least one embodiment. As illustrated in FIG. 4A, the pins 302 may be in a disengaged position at least because a gap remains from a further profile 306, which is opposite the angled profile 304 of the pins 302, with respect to a surface of the housing of the casing hanger spool 118. Further, as illustrated, a surface 402 of the tubular 116 interfaces with the textures of the inner profile 216 of the slip segments 222A; 222B. This interface may not be under one or more of axial movement or radial forces to the extent as to cause radial movement of the pins 302. However, when a downward axial movement occurs for the slip segments 222A; 222B, which may be caused by the tubular 116 or by other reactive forces in the wellbore, then an engagement of the pins 302 with the housing of the casing hanger spool 118 may occur, as detailed in FIGS. 5A-5B.

Figure 4B:
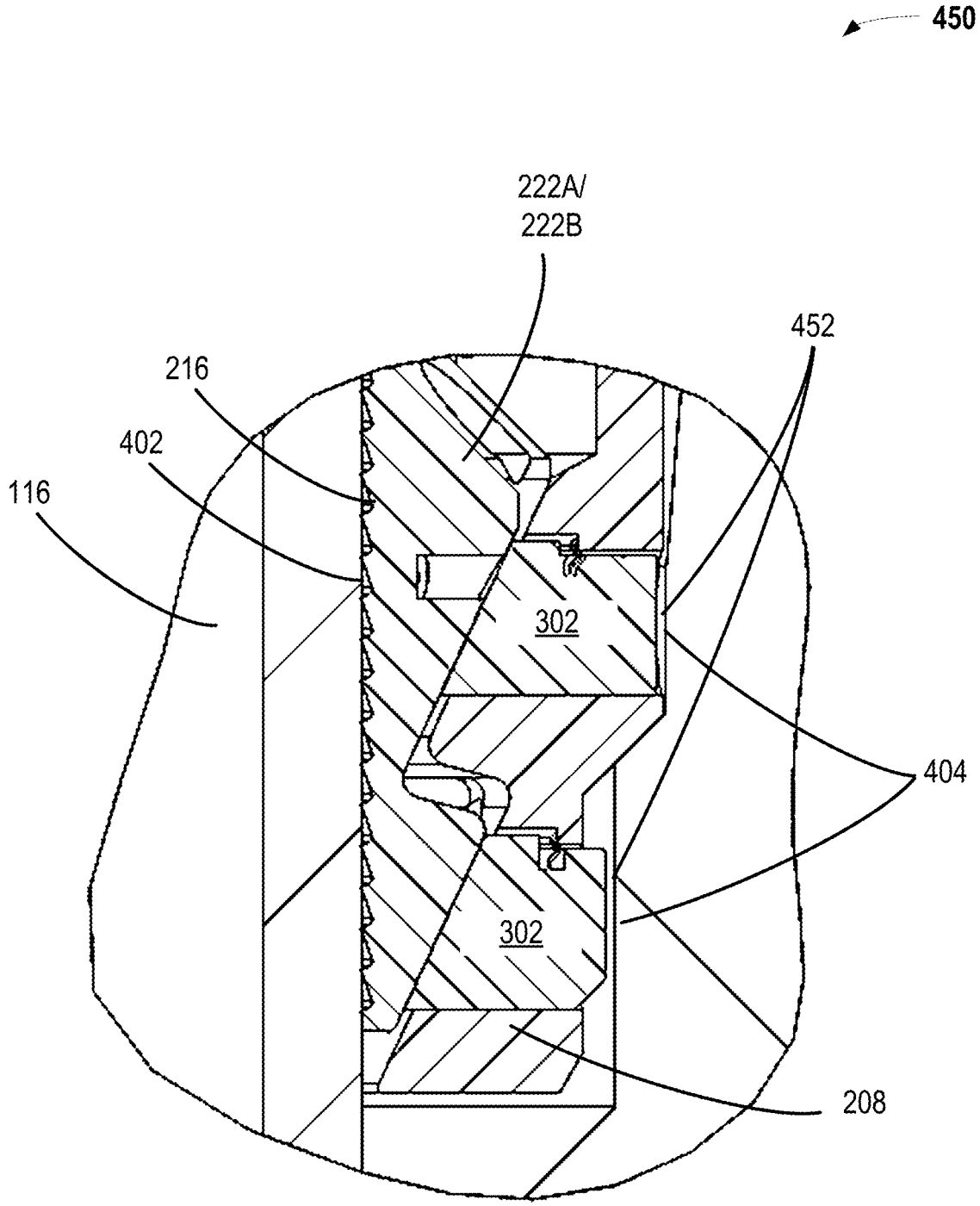
FIG. 4B is a detailed section view of aspects of the pins in the disengaged position, from FIG. 4A, in accordance with at least one embodiment.

FIG. 4B is a detailed section view of aspects 450 of the pins in the disengaged position, from FIG. 4A, in accordance with at least one embodiment. As illustrated in FIG. 4B, the pins 302 may be in a disengaged position at least because a gap 452 that remains from a further profile 306, which is opposite the angled profile 304 of the pins 302, with respect to a surface of the housing of the casing hanger spool 118. Further, as illustrated, a surface 402 of the tubular 116 interfaces with the textures of the inner profile 216 of the slip segments 222A; 222B. This interface may not be under one or more of axial movement or radial forces to the extent as to cause radial movement of the pins 302. However, when a downward axial movement occurs for the slip segments 222A; 222B, which may be caused by the tubular 116 or by other reactive forces in the wellbore, then an engagement of the pins 302 with the housing of the casing hanger spool 118 may occur, as detailed in FIGS. 5A-5B.

In addition, the illustrated aspects 450 in FIG. 4B and aspects 400 in FIG. 4A may also occur when the pins 302 are caused to in a disengaged position at least because a gap 452 that remains from a further profile 306, with respect to a surface of the housing of the casing hanger spool 118, for purposes of retrieval of the slip hanger. For example, as illustrated, a surface 402 of the tubular 116 interfaces with the textures of the inner profile 216 of the slip segments 222A; 222B. This interface may be under one or more of axial movement or radial forces to the extent as to cause radial movement of the pins 302 for the engagement described with respect with FIGS. 5A, 5B. However, when it is desired to retrieve the slip hanger, an upward axial movement may be caused to occur for the slip segments 222A; 222B, which may be caused by the tubular 116 or by other imparted forces in the wellbore. Then, the aforementioned interface may be under one or more of axial movement to reduce radial forces to the extent as to cause radial inward movement 320 of the pins 302. This can cause disengagement of the pins 302 with the housing of the casing hanger spool 118, to provide the disengagement positions illustrated in FIGS. 4A, 4B.

Figure 5A:
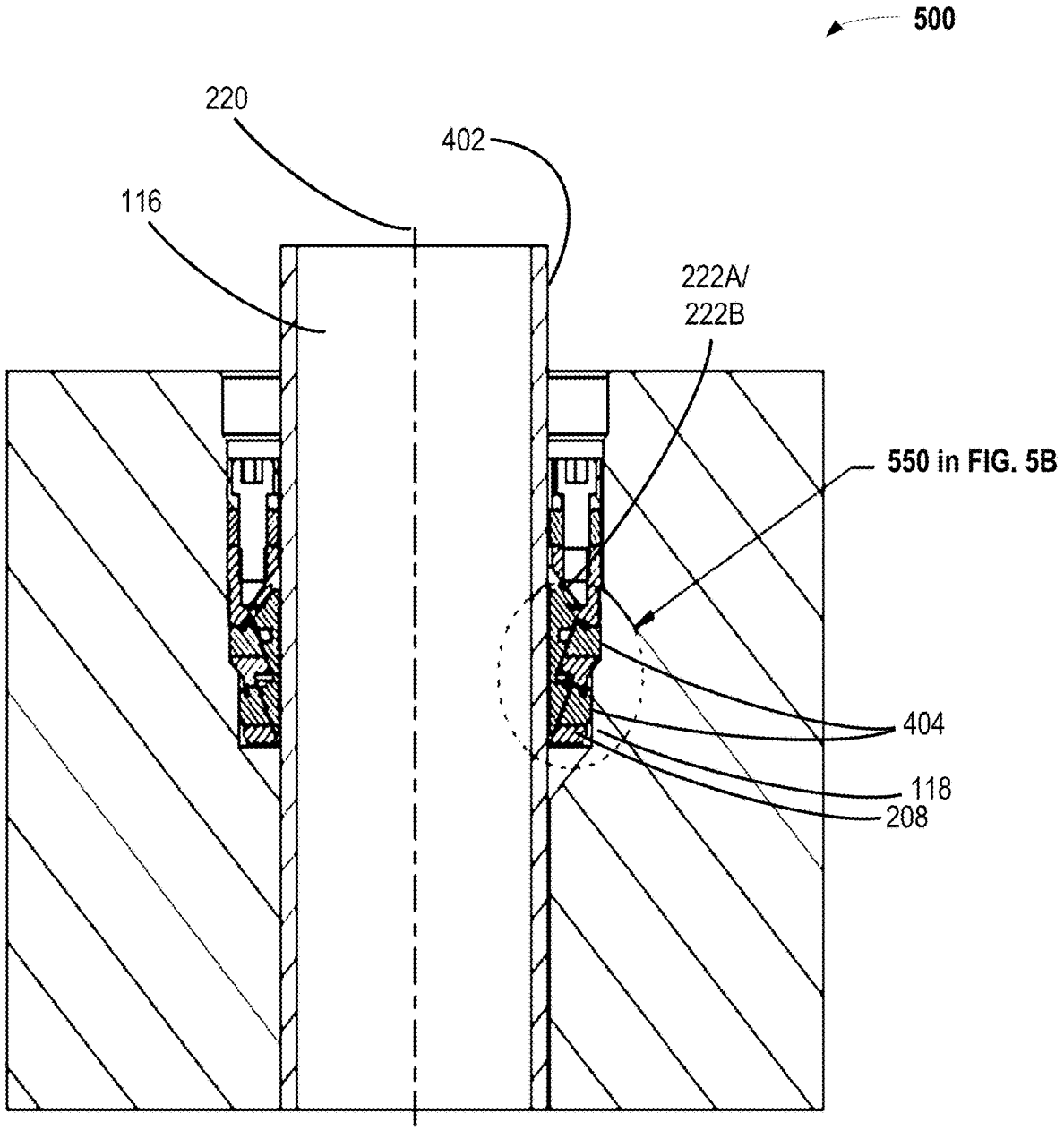
FIG. 5A is a section view of aspects of a slip hanger or a packoff having pins with a self-retractive attribute and in an engaged position, in accordance with at least one embodiment.

FIG. 5A is a section view of aspects 500 of a slip hanger or a packoff having pins with a self-retractive attribute and in an engaged position, in accordance with at least one embodiment. As illustrated in FIG. 5A, the pins 302 may be in an engaged position at least because a gap has closed 552 from a further profile 306, which is opposite the angled profile 304 of the pins 302, with respect to a surface of the housing 404 of the casing hanger spool 118. Further, as illustrated, a surface 402 of the tubular 116 interfaces with the textures of the inner profile 216 of the slip segments 222A; 222B. Here, this interface may be under one or more of axial movement or radial forces. For example, a downward axial movement may be caused for the slip segments 222A; 222B, which may be by the tubular 116 or by other reactive forces in the wellbore, then engagement of the pins 302 with the housing of the casing hanger spool 118 occurs. In at least one embodiment, the engagement remains till the aforementioned interface is not under one or more of axial movement or radial forces to the extent to cause deenergizing and unloading of the spring feature 310. For example, the axial movement need not be continuous but the at least prat of the radial forces may be continuous to cause the energizing and loading of the spring feature 310 so that the pins remain engaged.

Figure 5B:
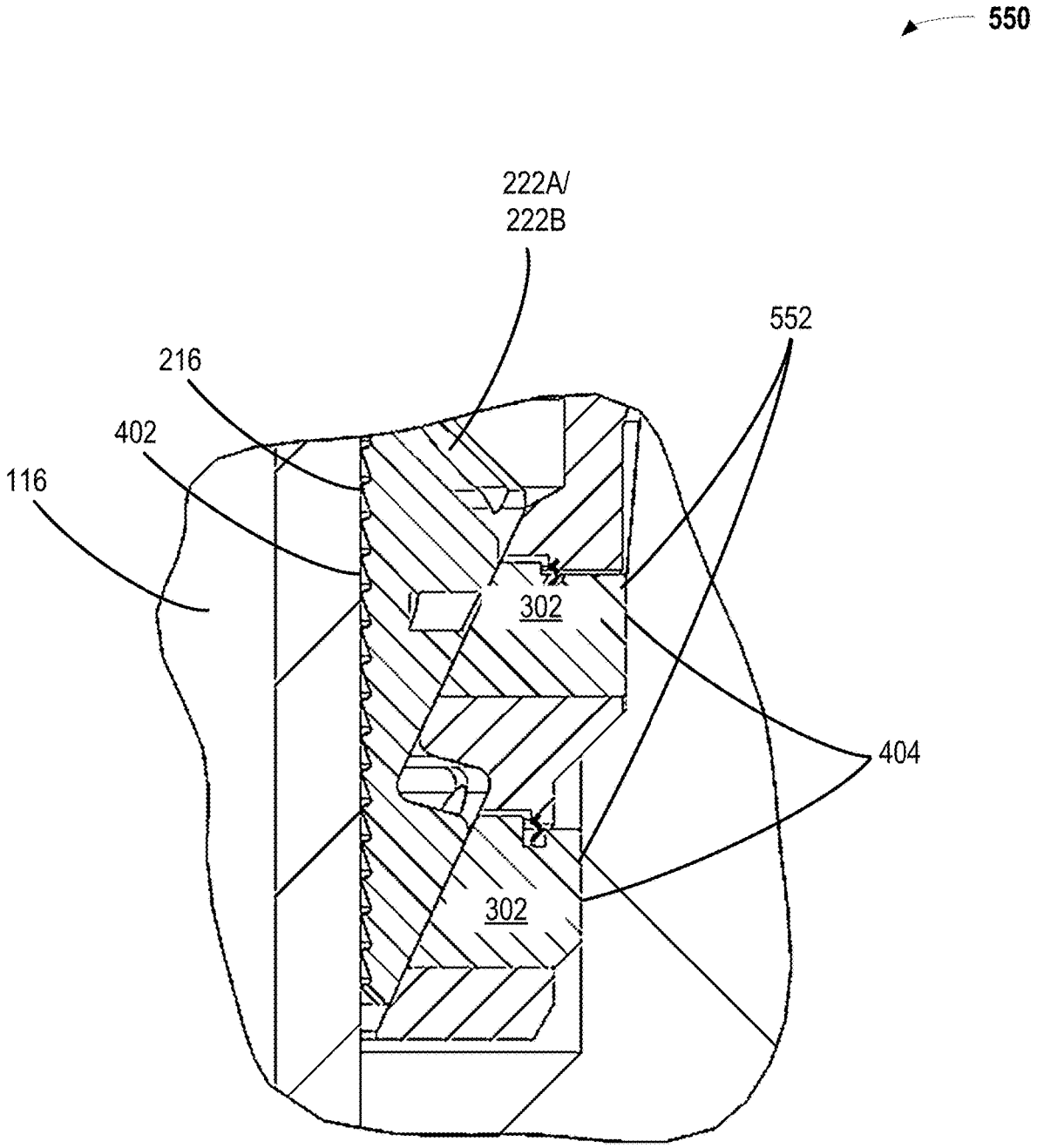
FIG. 5B is a detailed section view of aspects of the pins in the engaged position, from FIG. 5A, in accordance with at least one embodiment.

FIG. 5B is a detailed section view of aspects of the pins in the engaged position, from FIG. 5A, in accordance with at least one embodiment. As illustrated in FIG. 5B, the pins 302 may be in an engaged position at least because a gap which is opposite the angled profile 304 of the pins 302, with respect to a surface of the housing of the casing hanger spool 118. Further, as illustrated, a surface 402 of the tubular 116 interfaces with the textures of the inner profile 216 of the slip segments 222A; 222B. This interface may not be under one or more of axial movement or radial forces to the extent as to cause radial movement of the pins 302. However, when a downward axial movement occurs for the slip segments 222A; 222B, which may be caused by the tubular 116 or by other reactive forces in the wellbore, then an engagement of the pins 302 with the housing of the casing hanger spool 118 may occur, as detailed in FIGS. 5A-5B.

Figure 6:
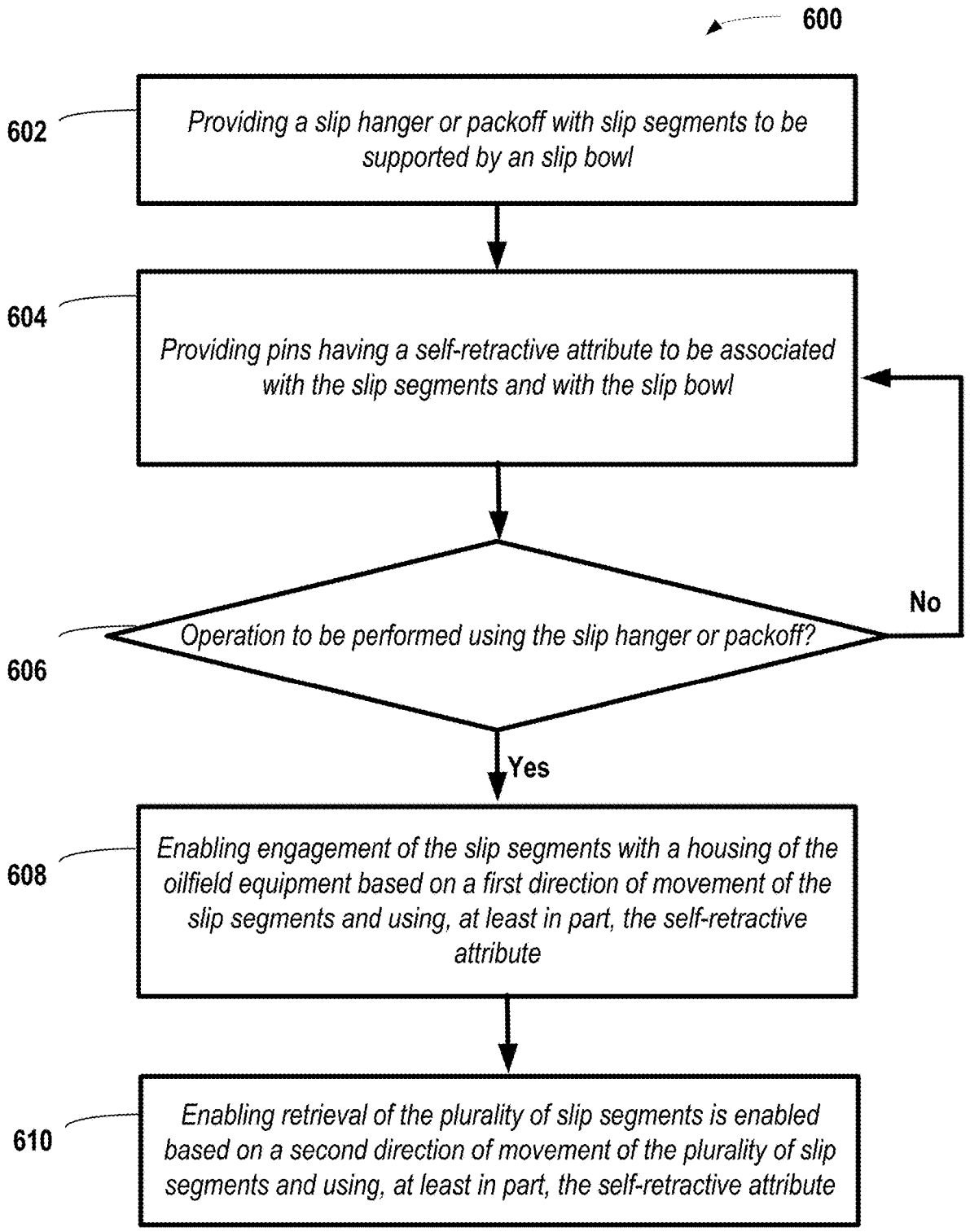
FIG. 6 is a flow diagram of a method for a system of a slip hanger or a packoff having pins with a self-retractive attribute that is described at least in FIGS. 1-5B herein, in accordance with at least one embodiment.

FIG. 6 is a flow diagram of a method 600 for a system of a combination set for a slip hanger or a packoff having inner bowl segments that is described at least in FIGS. 1-5C herein, in accordance with at least one embodiment. The method 600 is for a slip hanger or a packoff to be used with an oilfield equipment. The method 600 includes providing 602 slip segments to be supported by a slip bowl. The method 600 includes providing pins having a self-retractive attribute to be associated with the slip segments and with the slip bowl. In at least one embodiment, therefore, such aspects 602, 604, in the method 600 herein may be performed as part of manufacture of a slip hanger or packoff or may be performed as part of an installation of a slip hanger or packoff.

The method 600 includes determining or verifying 606 that an operation is to be performed using the slip hanger or packoff. The method 600 includes enabling 608, by at least in part the self-retractive attribute, engagement of the slip segments with a housing of the oilfield equipment based on a first direction of movement of the slip segments. In one example, the step of enabling 608 engagement includes allowing, by at least in part the self-retractive attribute, engagement of the slip segments with a housing of the oilfield equipment based in part on a first direction of movement of the slip segments. The housing may be surrounding, at least partially, the slip bowl. The self-retractive attribute may be provided, at least in part, by an angled profile for individual ones of the pins. The angled profile may be to interface with a corresponding angled profile of individual ones of the slip segments. A second direction of movement of the slip segments may allow disengagement of the pins from the housing and may allow retraction of the pins into the slip bowl by the self-retractive attribute. The second direction of movement may be to support the further enabling 610 step in the method 600 of FIG. 6.

Further, the method 600 also supports retrieval 610 of the slip segments, which may be enabled based on a second direction of movement of the slip segments and using at least in part the self-retractive attribute for the pins. The method 600 herein may include a further step or sub-step for the first direction of movement of the slip segments to be a downward axial movement with respect to an axis of the wellbore. The method 600 herein may include a further step or sub-step for the second direction of movement of the slip segments to be an upward axial movement with respect to the axis of the wellbore.

The method 600 herein may include a further step or sub-step for the self-retractive attribute to be provided, at least in part, by an angled profile for individual ones of the pins. The angled profile is provided to interface with a corresponding angled profile of individual ones of the slip segments during the second direction of movement for the retrieval of the slip segments, which may include retrieval of the slip hanger or packoff entirely. The second direction of movement can enable disengagement of the pins from the housing and enables retraction of the pins into the slip hanger or packoff.

The method 600 herein may include a further step or sub-step for the self-retractive attribute to be provided, at least in part, by an angled profile for individual ones of the pins. The angled profile can be provided to interface with a corresponding angled profile of individual ones of the slip segments during the first direction of movement for the engagement of the slip segments with the housing. The first direction of movement can enable the engagement of the pins with the housing based in part of an extension of the pins into the housing from slip hanger or packoff.

The method 600 herein may include a further step or sub-step for enabling, using the pins, transfer of radial forces from a tubular string to the housing. The radial forces may be associated with the slip segments, in one example. The method 600 herein may include a further step or sub-step for enabling the transfer of radial forces to be an automatic transfer based at least in part on the first direction of movement of the slip segments that causes interaction of the slip segments against the pins. The method 600 herein may include a further step or sub-step for the slip bowl to include pass-through features to enable the pins to pass through the slip bowl and to be in engagement with the housing. Therefore, aspects of the method 600 herein may be performed in manufacture or installation for the slip hanger or packoff.

The method 600 herein may include a further step or sub-step for the individual ones of the pins to include a retention feature to prevent the individual ones of the pins from extending past a threshold of radial movement available in the individual ones of the pins. The method 600 herein may include a further step or sub-step for the individual ones of the pins to include a spring feature to allow for a radial outward movement and retraction inward movement, with respect to at least a threshold of radial movement, for the individual ones of the pins.

The method 600 herein may include a further step or sub-step for the individual ones of the pins to be in complementary locations in the system to provide substantially equal distribution of radial forces in radial directions. The method 600 herein may include a further step or sub-step for the pins to include a first set of the pins and a second set of pins. The first set of pins can be provided above the second set of the pins. The first set of pins can be in engagement with the housing independent of or concurrent with the second set of the pins.

While techniques herein may be subject to modifications and alternative constructions, these variations are within spirit of present disclosure. As such, certain illustrated embodiments are shown in drawings and have been described above in detail, but these are not limiting disclosure to specific form or forms disclosed; and instead, cover all modifications, alternative constructions, and equivalents falling within spirit and scope of disclosure, as defined in appended claims.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present invention are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Recitation of ranges of values herein are merely intended to serve as a shorthand method of referring individually to each separate value falling within range, unless otherwise indicated herein and each separate value is incorporated into specification as if it were individually recited herein. In at least one embodiment, use of a term, such as a set (for a set of items) or subset unless otherwise noted or contradicted by context, is understood to be nonempty collection including one or more members. Further, unless otherwise noted or contradicted by context, term subset of a corresponding set does not necessarily denote a proper subset of corresponding set, but subset and corresponding set may be equal.

Conjunctive language, such as phrases of form, at least one of A, B, and C, or at least one of A, B and C, unless specifically stated otherwise or otherwise clearly contradicted by context, is otherwise understood with context as used in general to present that an item, term, etc., may be either A or B or C, or any nonempty subset of set of A and B and C. In at least one embodiment of a set having three members, conjunctive phrases, such as at least one of A, B, and C and at least one of A, B and C refer to any of following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present. In addition, unless otherwise noted or contradicted by context, terms such as plurality, indicates a state of being plural (such as, a plurality of items indicates multiple items). In at least one embodiment, a number of items in a plurality is at least two but can be more when so indicated either explicitly or by context. Further, unless stated otherwise or otherwise clear from context, phrases such as based on means based at least in part on and not based solely on.

In at least one embodiment, even though the above discussion provides at least one embodiment having implementations of described techniques, other architectures may be used to implement described functionality, and are intended to be within scope of this disclosure. In addition, although specific responsibilities may be distributed to components and processes, they are defined above for purposes of discussion, and various functions and responsibilities might be distributed and divided in different ways, depending on circumstances.

In at least one embodiment, although subject matter has been described in language specific to structures and/or methods or processes, it is to be understood that subject matter claimed in appended claims is not limited to specific structures or methods described. Instead, specific structures or methods are disclosed as example forms of how a claim may be implemented.

From all the above, a person of ordinary skill would readily understand that the tool of the present disclosure provides numerous technical and commercial advantages and can be used in a variety of applications. Various embodiments may be combined or modified based in part on the present disclosure, which is readily understood to support such combination and modifications to achieve the benefits described above.

It should be appreciated that embodiments herein may utilize one or more values that may be experimentally determined or correlated to certain performance characteristics based on operating conditions under similar or different conditions. The present disclosure described herein, therefore, is well adapted to carry out the objects and attain the ends and advantages mentioned, as well as others inherent therein. While a presently preferred embodiment of the disclosure has been given for purposes of disclosure, numerous changes exist in the details of procedures for accomplishing the desired results. These and other similar modifications will readily suggest themselves to those skilled in the art and are intended to be encompassed within the spirit of the present disclosure disclosed herein and the scope of the appended claims.

What is claimed is:

1. A system for a slip hanger or a packoff to be used with oilfield equipment, comprising:

a plurality of slip segments supported by a slip bowl and associated with a plurality of pins having a self-retractive attribute, wherein the self-retractive attribute is configured to allow engagement of the plurality of slip segments with a housing of the oilfield equipment based in part on a first direction of movement of the plurality of slip segments, wherein the housing surrounds, at least partially, the slip bowl, wherein the self-retractive attribute is provided, at least in part, by an angled profile for individual ones of the plurality of pins, wherein the angled profile is to interface with a corresponding angled profile of individual ones of the plurality of slip segments, and wherein a second direction of movement of the plurality of slip segments allows disengagement of the plurality of pins from the housing by the self-retractive attribute and allows retraction of the plurality of pins into the slip bowl by the self-retractive attribute.

2. The system of claim 1, wherein the first direction of movement of the plurality of slip segments is a downward axial movement with respect to an axis of a wellbore and the second direction of movement of the plurality of slip segments is an upward axial movement with respect to the axis of the wellbore.

3. The system of claim 1, wherein the plurality of pins is to allow retrieval of the plurality of slip segments based in part on a second direction of movement of the plurality of slip segments.

4. The system of claim 1, wherein the self-retractive attribute is provided, at least in part, by an angled profile for individual ones of the plurality of pins, wherein the angled profile is to interface with a corresponding angled profile of individual ones of the plurality of slip segments during the first direction of movement for the engagement of the plurality of slip segments with the housing, and wherein the first direction of movement allows the engagement of the plurality of pins with the housing based in part on an extension of the plurality of pins into the housing from slip hanger or packoff.

5. The system of claim 1, wherein the plurality of pins allow transfer of radial forces, from a tubular string associated with the plurality of slip segments, into the housing, and wherein at least the first direction of movement supports the transfer of the radial forces being an automatic transfer based at least in part on the first direction of movement of the plurality of slip segments causing interaction of the plurality of the slip segments against the plurality of pins.

6. The system of claim 1, wherein the slip bowl comprises a plurality of pass-through features to allow the plurality of pins to pass through the slip bowl and to be in engagement with the housing.

7. The system of claim 1, wherein individual ones of the plurality of pins comprise a retention feature to prevent the individual ones of the plurality of pins from extending past a threshold of radial movement available in the individual ones of the plurality of pins.

8. The system of claim 1, wherein individual ones of the plurality of pins comprise a spring feature, as part of the self-retractive attribute, the spring feature to allow for a radial outward movement and retraction inward movement, with respect to at least a threshold of radial movement, for the individual ones of the plurality of pins.

9. The system of claim 1, wherein individual ones of the plurality of pins are in complementary locations to provide substantially equal distribution of radial forces in a plurality of radial directions.

10. The system of claim 1, wherein the plurality of pins comprise a first set of the plurality of pins and a second set of the plurality of pins, wherein the first set of the plurality of pins is provided above the second set of the plurality of pins, and wherein the first set of the plurality of pins is to be in engagement with the housing independent of or concurrent with the second set of the plurality of pins.

11. A method for a slip hanger or a packoff to be used with oilfield equipment, comprising:

providing a plurality of slip segments to be supported by a slip bowl;

providing a plurality of pins having a self-retractive attribute to be associated with the plurality of slip segments and with the slip bowl; and allowing, by at least in part the self-retractive attribute, engagement of the plurality of slip segments with a housing of the oilfield equipment based in part on a first direction of movement of the plurality of slip segments, wherein the housing surrounds, at least partially, the slip bowl, wherein the self-retractive attribute is provided, at least in part, by an angled profile for individual ones of the plurality of pins, wherein the angled profile is to interface with a corresponding angled profile of individual ones of the plurality of slip segments, and wherein a second direction of movement of the plurality of slip segments allows disengagement of the plurality of pins from the housing and allows retraction of the plurality of pins into the slip bowl by the self-retractive attribute.

12. The method of claim 11, wherein the first direction of movement of the plurality of slip segments is a downward axial movement with respect to an axis of a wellbore and the second direction of movement of the plurality of slip segments is an upward axial movement with respect to the axis of the wellbore.

13. The method of claim 11, further comprising:

retrieving the plurality of slip segments based in part on the second direction of movement of the plurality of slip segments.

14. The method of claim 11, wherein the self-retractive attribute is provided, at least in part, by an angled profile for individual ones of the plurality of pins, wherein the angled profile is to interface with a corresponding angled profile of individual ones of the plurality of slip segments during the first direction of movement for the engagement of the plurality of slip segments with the housing, and wherein the first direction of movement allows the engagement of the plurality of pins with the housing based in part on an extension of the plurality of pins into the housing from slip hanger or packoff.

15. The method of claim 11, further comprising:

allowing, using the plurality of pins, transfer of radial forces from a tubular string to the housing, the radial forces associated with the plurality of slip segments; and allowing the transfer of radial forces to be an automatic transfer based at least in part on the first direction of movement of the plurality of slip segments that causes interaction of the plurality of the slip segments against the plurality of pins.

16. The method of claim 11, wherein the slip bowl comprises a plurality of pass-through features to allow the plurality of pins to pass through the slip bowl and to be in engagement with the housing.

17. The method of claim 11, wherein individual ones of the plurality of pins comprise a retention feature to prevent the individual ones of the plurality of pins from extending past a threshold of radial movement available in the individual ones of the plurality of pins.

18. The method of claim 11, wherein individual ones of the plurality of pins comprise a spring feature, as part of the self-retractive attribute, the spring feature to allow for a radial outward movement and retraction inward movement, with respect to at least a threshold of radial movement, for the individual ones of the plurality of pins.

19. The method of claim 11, wherein individual ones of the plurality of pins are in complementary locations to provide substantially equal distribution of radial forces in a plurality of radial directions.

20. The method of claim 11, wherein the plurality of pins comprise a first set of the plurality of pins and a second set of the plurality of pins, wherein the first set of the plurality of pins is provided above the second set of the plurality of pins, and wherein the first set of the plurality of pins is to be in engagement with the housing independent of or concurrent with the second set of the plurality of pins.

* * * * *